United States Patent [19]

McDaniels

[11] Patent Number: 4,790,119

[45] Date of Patent: Dec. 13, 1988

[54] MACHINE AND PROCESS FOR ORGANIZING PUBLICATIONS FOR DISTRIBUTION IN A POSTAL SYSTEM

[75] Inventor: Paul T. McDaniels, Effingham, Ill.

[73] Assignee: World Color Press, Inc., Effingham, Ill.

[21] Appl. No.: 83,109

[22] Filed: Aug. 10, 1987

[51] Int. Cl.[4] ..... B65B 61/02

[52] U.S. Cl. ..... 53/411; 53/461; 53/131; 53/155; 53/550; 53/493

[58] Field of Search ..... 53/411, 461, 474, 131, 53/154, 155, 550, 493; 270/54

[56] References Cited

U.S. PATENT DOCUMENTS

| | | | |
|---|---|---|---|
| 3,206,043 | 9/1965 | Kile . | |
| 3,608,888 | 9/1971 | McCain | 270/54 |
| 4,022,455 | 5/1977 | Newsome | 270/54 |
| 4,484,733 | 11/1984 | Loos | 53/131 |
| 4,639,873 | 1/1987 | Baggarly | 53/154 |

*Primary Examiner*—John Sipos

*Attorney, Agent, or Firm*—Gravely, Lieder & Woodruff

[57] ABSTRACT

An electronic computer orders magazines of multiple titles from dispensing units, each of which has a single title assigned to it, and these orders are organized by carrier route, that is to say all magazines for subscribers of a specific carrier route are ordered in sequence. The orders are directed to a magazine dispensing unit which has a different pocket for each title, and these pockets deliver to the conveyor one after the other magazines that fill the subscriptions to which the various addresses pertain. The computer also causes the insert dispensing unit to deposit on the magazines as those magazines pass under the unit inserts that are appropriate to the magazine and its subscriber. Next a wrapping machine places a transparent polymer film around the magazine and any insert which is on it. Then the conveyor carries the magazine past an ink jet printing unit where the subscriber's name and address are applied to the polymer envelope, the printing unit likewise being connected to the computer. The conveyor thereafter deposits the magazines one after another in a stacking machine, which is also under the control of the computer, and it arranges the magazines in stacks which comply with the requirements for carrier route sortation, in that each stack has magazines addressed to a single carrier route, contains the minimum number of magazines, and does not exceed the prescribed weight.

16 Claims, 2 Drawing Sheets

MACHINE AND PROCESS FOR ORGANIZING PUBLICATIONS FOR DISTRIBUTION IN A POSTAL SYSTEM

BACKGROUND OF THE INVENTION

This invention relates in general to the distribution of magazines and similar publications and more particularly to a machine and process for organizing magazines of different titles for the most economical distribution through the postal system.

Current postal regulations provide a favorable mailing rate for magazines which are arranged in bundles, each of which contains only magazines addressed to subscribers of a single postal route. As such, the bundles, in contrast to conventional mail, pass directly through the postal system to the carrier route without sorting and processing at several intermediate stations. However, the regulations require that each bundle contain a minimum number of magazines—currently six—and that it not exceed a prescribed weight.

Many publications have less than the minimum number of subscribers in many of the postal routes to which they are sent, and as a consequence the magazines which are mailed to these routes require higher postage rates.

Also, publishers of magazines on occasion provide supplementary materials with their magazines or with specific issues or perhaps with the issues that are addressed to selected subscribers. For example, if a subscription is about to expire, the publisher will often enclose a card in the last and next to last issue reminding the subscriber of the imminent expiration of the subscription and encouraging him to renew the subscription. Similarly, some publishers distribute advertising material as inserts on a regional basis only. Irrespective of the nature of the insert, the magazine to which it is consigned is normally spread open a slight amount, and the insert is projected into its open pages so that it lodges between two of those pages. While the chances that the insert will enter the magazine are quite good, the chances of the insert remaining with the magazine and reaching the subscriber are somewhat less, because the possibility always exists that the insert will fall out of the magazine as it is handled within the postal system. A better procedure is to wrap the magazine in an envelope, for this not only prevents loss of the insert, but further preserves the appearance of the magazine, particularly its cover.

A principal object of the present invention is to combine or commingle magazines of different titles into common bundles to obtain enough magazines in each bundle to classify for the more favorable postal rate accorded for so-called carrier route sortation. Also, it is an object to apply inserts in the form of cards or even small brochures to selected magazines and to wrap each magazine and any insert applied to it in a transparent envelope so that the insert and magazine do not become separated or soiled in the postal system. Another object is to apply the subscriber's name to the envelope or insert by ink jet printing techniques.

DESCRIPTION OF THE DRAWINGS

In the accompanying drawings which form part of the specification and wherein like numerals and letters refer to like parts wherever they occur

DETAILED DESCRIPTION

Figure 1:
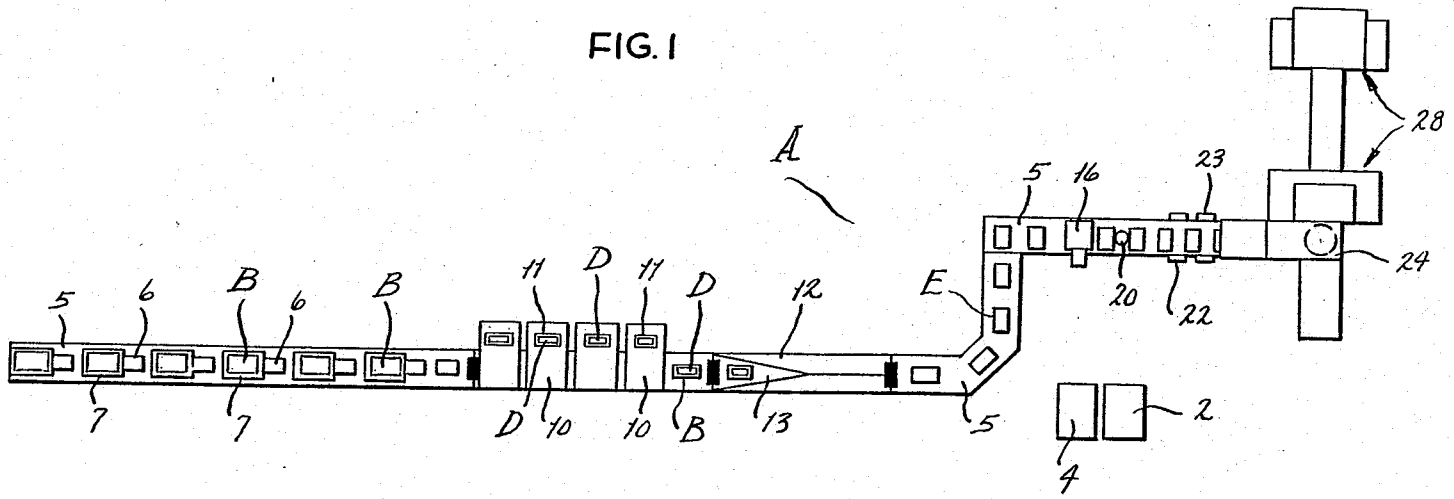
FIG. 1 is a schematic plan view of a machine constructed in accordance with and embodying the present invention.
Figure 2:
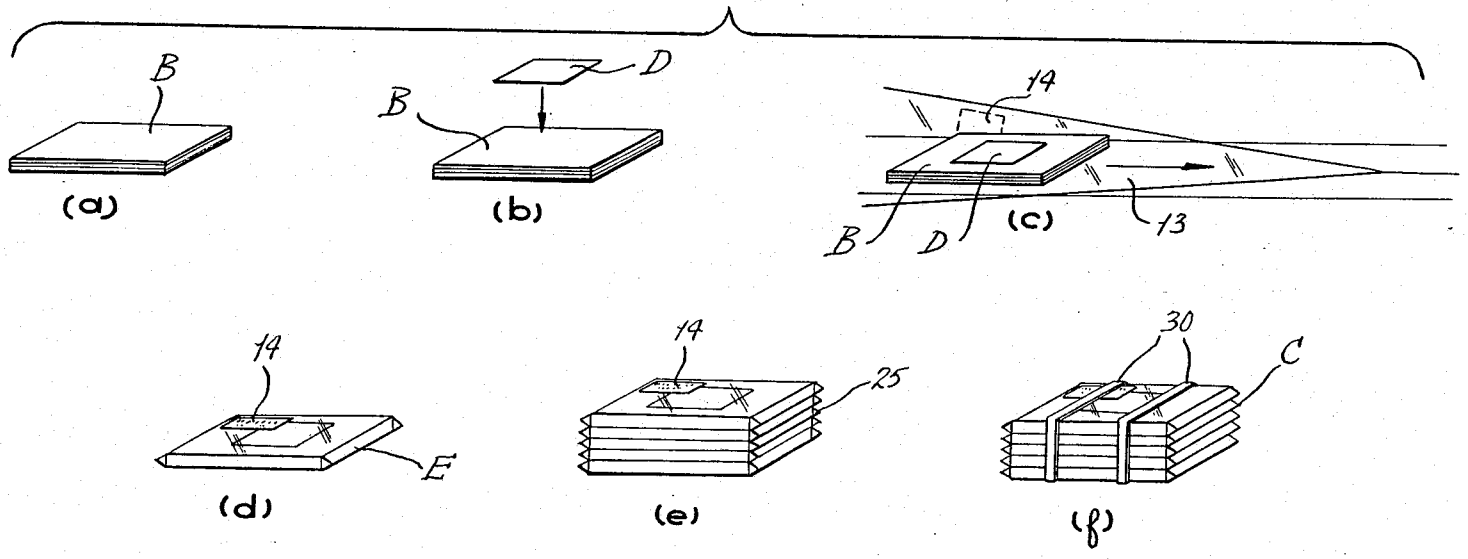
FIG. 2 schematically shows the various operations encountered by a magazine in the machine.

Referring now to the drawings, a machine A (FIG. 1) organizes magazines B, or other publications of various titles into bundles C (FIG. 2), and in so doing applies inserts D to selected magazines B and wraps the magazines B as well as any inserts D which may be applied to them in transparent envelopes E. In addition, the machine A applies the subscribers' names and addresses to the envelopes E, or the inserts D or even the magazine B, this being effected by so-called ink jet printing.

Figure 3:
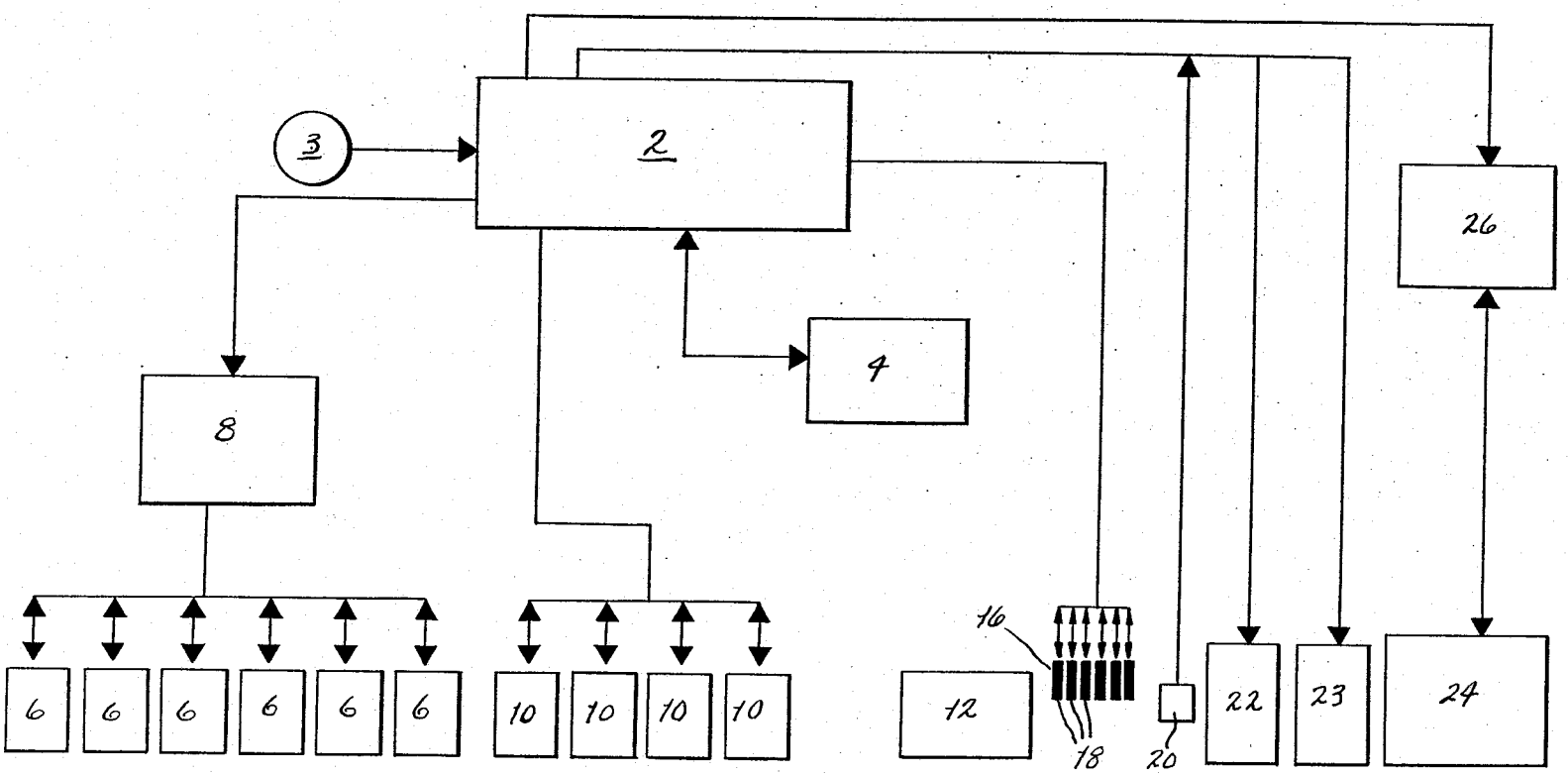
FIG. 3 is a block diagram showing the computer control for the machine.

The machine A is controlled by its own main computer 2 (FIG. 3) which is operated from a console 4. The computer 2, which is a digital computer, holds the basic operating instructions for the machine A, and the instructions enable it to track the magazines B through the machine A and cause components of the machine A to perform various operations on the magazines B. Moreover, the computer 2 reads a magnetic tape 3 which carries the names of subscribers for the several magazine titles assigned to the machine A, as well as the addresses of those subscribers and the titles to which they subscribe. The tape 3 also contains additional information that determines the type of insert D, if any, a particular magazine B will receive. The computer 2 possesses a limited memory and extracts the names and corresponding information from the tape 3 in groups, holding those names in its memory as the magazines B to which they pertain pass through the machine A. The main computer 2 is of the type supplied with ink jet printing systems. It is operated from a console 4.

Aside from the computer 2, the machine A includes a conveyor 5 which may consist of several belts that move side-by-side over a smooth flat surface. Any magazine B which falls onto the moving belts will be transported at the velocity of those belts to that end of the conveyor toward which the belts move. Actually the belts move from the feed end of the conveyor 5 where the magazines B are deposited on the conveyor 5 to the discharge end of the conveyor 5 and thus establish a path that the magazines B follow as they move through the machine B. The conveyor 5 may consist of a single straight run, or two or more runs located at angles with respect to each other.

At the feed end of the conveyor 5, where the conveyor belts come up onto the flat surface, several magazine feed units 6 are arranged over the conveyor 5, one after the other. Each includes a pocket 7 which holds quite a few magazines B, all of the same title, in a stack and a mechanism for releasing the magazines B one at a time. Indeed, each feed unit 6 upon receiving a signal drops one magazine B onto the belts of the conveyor 5 with either the back or front cover page of the magazine B presented downwardly so that the downwardly presented page will come against the moving belts of the conveyor 4, thus enabling the magazine B to be transported along the conveyor 2 in a flat condition. The signal is electronic in character and derives from a single programmable controller 8 (FIG. 3) to which all of the feed units 6 are connected. The controller 8 is in turn connected to the main computer 2. Indeed, the main computer 2, upon extracting names and other information from the magnetic tape 3, directs signals to the programmer 8, each signal calling for a specific magazine B. The controller 8 in turn converts that signal into another signal or command which is directed to the appropriate magazine feed unit 6, causing that unit to deposit a single magazine B on the conveyor 5. The controller 8 further insures that the magazines B are dispensed in the proper sequence and that a generally uniform spacing exists between successive magazines, notwithstanding the arrangement of the units 6 one after the other along the conveyor 5. Thus, even though the signals from the main computer 2 may call for a magazine B from the unit 6 farthest upstream on the conveyor 5 and next from the unit 6 farthest downstream, the controller 8 insures that the magazine B dispensed from the upstream unit 6 clears the downstream unit 6 before the latter dispenses its magazine B, and that the latter further dispenses such that a prescribed spacing exists between the two magazines B. The magazine feed units 6 are conventional to the printing industry, and are often referred to as book pockets.

Next along the conveyor 5 are several insert feed units 10, each of which has a hopper 11 which contains a stack of inserts D. These inserts D may take the form of relatively stiff cards or more flexible multipage brochures. While the inserts C within any feed unit 10 are identical, the inserts C may and usually will vary with the feed units 10, each containing a stack of different inserts D. The feed units 10 for the inserts D, like the feed units 6 for the magazines B, are arranged one after the other along the conveyor 4. Each projects over the conveyor 5 and contains an actuating mechanism which, when triggered, releases a single insert D so that it drops with one face presented downwardly. This mechanism is actuated by a signal from the main computer 2 to which the several feed units 10 are connected. The computer 2 selects the magazine B to which an insert D is to be applied and also selects what type of insert D is to be applied. It further delays the signal to the feeding device 10 for that insert D long enough to enable the insert D to drop directly onto the magazine B to which it is assigned as that magazine B passes beneath the feed unit 10 on the conveyor 5. The feed units 10 are conventional to the printing industry where they are often referred to as insert pockets.

After the feed units 10 comes a wrapping machine 12 which directs a transparent polymer film 13 beneath each magazine B and any insert D that may be on that magazine and further folds it over the magazine B and insert D. Indeed, the wrapping machine 12 forms transverse heat seals in the polymer film 13 at both ends of the magazine B as well as a longitudinal heat seal between the two transverse heat seals and further severs the polymer film 13 from the roll, thus producing a clear polymer envelope E (FIG. 2) which totally encapsulates the magazine B and whatever insert D that is against it. The polymer film 13 of the envelope E should contain a region 14 of opacity or near opacity for accommodating the name and address of the subscriber to the magazine. The magazine B, its envelope E and any insert D on the magazine B constitute a mailing piece.

The name and address are applied at the next station at which an ink jet printing unit 16 is located. That unit consists of several side-by-side heads 18 which are positioned over the conveyor 5 such that the opaque regions 14 of the envelope E pass directly under them. The heads 18 correspond in number to the number of lines in the address, name and supplemental lines included. The printing unit 16 is connected to the main computer 2 which causes the unit 16 to discharge ink in varying patterns which adhere to and dry on the opaque region 14 of the envelope E, producing the name and address of the subscriber as well as additional information if desired. While the name and address are for a time in the memory of the main computer 2, that computer derives them from the magnetic tape 3.

Located beyond the printing unit 16 is a sensor 20 which is a photoelectric device designed to detect the presence of magazines B on the conveyor 5. Indeed, the sensor 20 produces an electrical signal for each magazine B that passes by it on the conveyor 5, and those signals are transmitted to the main computer 2 which correlates the signals with the addresses applied at the printing unit 16. If the sensor 20 fails to detect a magazine B for any address previously applied at the printing unit 16, it reorders that magazine B, that is it causes the magazine feed unit 6 to dispense a magazine B of the proper title onto the conveyor 5 and likewise causes the insert feed to deposit the appropriate insert C on that magazine B and the printing unit 16 to apply the appropriate name and address.

Next comes a reject gate 22 which diverts all magazines B that are not suitable for being wrapped into bundles C. For example, if for some reason the machine loses its power momentarily, it will be incapable of tracking the magazines B that are already on the conveyor 5, and these magazines B must be reordered. No addresses are applied to these magazines B and they are merely removed from the conveyor 5 at the reject gate 22. Similarly, if the magazine has a partial label or a wrong label or the wrong quality control label it may be removed from the conveyor at the reject gate 22.

Following the reject gate is a divert gate 23 which deflects magazines B of the inappropriate carrier route from the conveyor 5 and into a separate bin to be delivered at the higher rate for single magazines. In this regard, the magnetic tape 3 has names and addresses organized by carrier route and supplies the computer 2 with names and addresses organized in that manner. However, if for some reason, the magazine unit 6 fails to deliver a magazine B for a particular subscriber or the magazine B which is delivered is somehow displaced from the conveyor 5, the sensor 20 will detect the absence of that magazine B and generate a signal which is directed to the computer 2. The computer 2, in turn, reorders the magazine B. By the time the reordered magazine reaches the conveyor 5, the feed units 6 may be dispensing magazines B for another carrier route, and if this is the case the computer 2 will actuate the divert gate 22 to deflect the reordered magazine B from the conveyor 5 so that it does not become commingled in a bundle C of magazines destined for a different carrier route. Indeed, the diverted magazine B is introduced into the postal system as a separate mailing piece at a somewhat higher postal rate. Thus, beyond the divert gate 22 the magazines B are organized strictly according to carrier route, that is to say, the magazines B for a particular carrier route follow one after the other until all of the magazines for that carrier route have passed, at which time the magazines B for the next carrier route proceed.

The computer 2 also actuates the divert gate 22 when not enough magazines exist in succession to meet the minimum requirements for carrier route sortation.

At the end of the conveyor 5, immediately after the divert gate 23, is a stacking machine 24 which accepts the magazines B from the conveyor 5 and places them in stacks 25. Machines possessing this capability are old, having been sold by Harris Graphics, Inc., for one, but the machines heretofore employed could only produce stacks of a specific count. The stacking machine 24 is coupled with a mail control computer 26 which in turn is connected to the main computer 2. The mail control computer 26 allows the stacking machine 24 to place magazines B for a single carrier route one on top of each other until the stack 25 so formed reaches a prescribed maximum weight, which is also established by postal regulations, at which time the stack 25 is ejected. It also insures that all of the magazines B in stack 25 are addressed to the same carrier route. To this end, the computer 24 does not read or scan the addresses on the individual envelopes E which encapsulate the magazines B, but instead tracks the magazines B through the main computer 2 with which it is connected. In addition, the computer 24 where at all possible insures that each stack 25 has the minimum number of magazines B in it, notwithstanding that one or more of the stacks 25 may not approach the maximum weight specified by postal regulations. For example, if the postal regulations require a minimum of six magazines per stack and the total magazines B for a particular carrier route is 14, which just exceeds the weight limit prescribed by the postal regulations, then the computer 26 will cause the stacking machine 24 to place eight magazines in one stack 25 and the minimum of six in the next.

The stacking machine 24 operates in conjunction with a binding machine 26 which places straps 28 around each stack 25 assembled by the stacking machine 24 to create the bundles C. In this regard, the stacking machine 24, once it completes the assembly of a stack 25, discharges the stack 25 laterally into the binding machine 28. Not being connected to either of the computers 2 or 26, the binding machine 28 operates on demand, placing the straps 30 around each stack 25 that enters it. The binding machine 28 is a conventional item of commerce in the printing industry.

OPERATION

Before the machine A is set into operation, it must of course be loaded with the various magazines B, inserts D and polymer film for the envelopes E, all of which are to be combined and assembled into the bundles C. In particular, the magazines B are loaded one upon the other into the pockets 7 of the magazine feed units 6, the pocket 7 of each feed unit 6 holding magazines B of a different title. Likewise, the hoppers 11 of the insert feeding units 10 are loaded with appropriate inserts D, and again each receives a different insert D, but the inserts D in the hopper 11 of each separate unit 10 are identical. Of course, the wrapping machine 12 is provided with a supply of transparent polymer film 13 suitable for conversion into envelopes E but having the opaque regions 14 already imprinted on it, while the binding machine 28 is provided with strapping for the straps 30. Finally, a magnetic tape 3 is prepared containing in a suitable code the names and addresses of subscribers to the magazines B of the several titles that are loaded into the magazine feed units 6. As to each subscriber's name the code of course contains an identification of the title to which he subscribes and also a designation for any insert D that is to accompany the magazine B. Actually, the tape 3 carries the subscribers' names organized by carrier route, but this service is performed by a so-called fulfillment company which prepares the tape. In any event the tape 3 has the names and addresses organized such that addresses having like carrier routes are together irrespective of the title of the magazine to which they apply.

Tracing a series of magazines B through the machine A, the main computer 2 selects the first name and address and directs a signal to the programmable controller 8 calling for a magazine B of the title designated for that name and address. The controller 8 in turn selects the magazine feed unit 6 which holds the magazine B of that title, and directs a signal to that unit 6 to cause it to dispense one magazine B onto the conveyor 5. The main computer 2 directs successive signals to the controller 8, each calling for another magazine B, and for each signal the controller 8 energizes the appropriate magazine feed unit 6, causing it to dispense a single magazine B of the appropriate title onto the conveyor 5. In so doing the controller 8 insures the magazines B remain in the order in which it received the signals for such magazines from the main computer 2 and that the proper spacing exists between successive magazines B on the conveyor 5. The magazines B advance one after the other along conveyor 5, and while successive magazines B may have different titles, they will all have the designation for a single carrier route—at least until the main computer 2 exhausts all names and addresses of the same carrier route. Like the first succession of magazines B, the next succession of magazines B is likewise consigned for subscribers of a single carrier route, although the titles of such magazines B may likewise differ, that is to say such magazines B may come from different magazine feeding units 6.

Once a magazine B is deposited on the conveyor 5, the main computer 2 tracks it along the full length of the conveyor 5 and indeed into the stacking machine 24. Thus, it knows when the magazine B passes beneath the insert feeding units 10, and if the magnetic tape 3 calls for a particular insert B for that magazine B, the main computer 2 will operate the appropriate insert feed unit 10 in time to cause that insert feed unit 10 to deposit an insert D on the magazine B.

The magazine B proceeds on to the wrapping machine 12 where a transparent film 13 of a suitable polymer is folded about it and its insert D and sealed and severed to produce a detached envelope E which completely encloses the magazine B this creating a separate mailing piece. The wrapping machine 12 operates independently of the computer 2, that is to say on demand, so that it places an envelope E around each magazine B that encounters it on the conveyor 2. The polymer film 13 which the wrapping machine 12 converts into envelopes E has the opaque regions 14 already imprinted on it, and the envelopes E leave the wrapping machine 12 each with its opaque region 14 presented upwardly and at a predetermined location on the magazine B.

The main computer 2 continues tracking the magazine B, and at the printing unit 16 it energizes the printing heads 18 so that each applies a different line of the subscriber's name and address to the opaque region 14 of the envelope E. Thus, the first printing head 18 will normally project ink droplets which produce a succession of letters that constitute the subscriber's name, while the next two or three heads 18 will produce numbers and letters constituting the subscriber's address. The last one or two heads 18 may be reserved for supplemental information.

If for some reason the appropriate magazine feeding unit 6 fails to dispense a magazine B or a magazine B which is dispensed is somehow displaced from the conveyor 2, the main computer 2 will in effect track a void along the conveyor 5, but the void will not go undetected. Indeed, the absence of a magazine B is detected by the sensor 20 which directs a signal to the main computer 2. Knowing what magazine B should have been at the void, the computer 2 will immediately reorder that magazine B by sending an appropriate signal to the programmable computer 8 which in turn actuates the appropriate magazine feeding unit 6. Hopefully, the magazine feeding units 6 are dispensing for the same carrier route at the time, but in any event the computer 2 tracks the reordered magazine along the conveyor 4 as any other magazine B.

Upon passing the sensor 20, the magazine B moves through the divert gate 23, unless the carrier route for which it is destined does not correspond to the carrier route or routes of those magazines B which are immediately ahead of or behind it on the conveyor 5, in which case the divert gate 23 will direct it into a nearby bin instead of allowing it to move on to the stacking machine 24. The same holds true if a succession of magazines B destined for the same carrier route numbers less than the minimum required to qualify as a so-called carrier route sortation.

The magazines B that qualify for carrier route sortation enter the stacking machine 25, and here the mail control computer 26 effects a count as the machine 24 arranges the magazines B in a stack 25 and further weighs the stack 25. Indeed, the computer 26 correlates information from the main computer 2 and from counting and weighing devices on the stacking machine 24 to insure that each stack 25 has only magazines B that are destined for a single carrier route and that each stack 25 contains the minimum number of magazines B to qualify as a carrier route sortation, while at the same time remaining within the weight limitations for that sortation.

Upon completing a stack 25, the stacking machine 24 discharges it into the banding machine 28 where straps 30 are placed around it.

In lieu of placing the printing unit 16 immediately beyond the wrapping machine 12, it may be installed immediately ahead of the machine 12, in which case the name and address will be printed on the inserts D or on the magazines B themselves. Indeed, two printing units 16 may be employed one ahead of the wrapping machine 12 and the other beyond the machine 12. The former applies special messages to the magazines B or inserts D, while the latter applies the name and address to the polymer film envelope E.

This invention is intended to cover all changes and modifications of the example of the invention herein chosen for purposes of the disclosure which do not constitute departures from the spirit and scope of the invention.

What is claimed is:

1. A machine for organizing publications of different titles for distribution in a postal or similar system, said machine comprising: a conveyor capable of moving the publications one after the other along a path; a plurality of publication dispensing units located along the path, with each holding identical publications of a specific title and being capable upon receipt of a command of dispensing onto the conveyor a publication of the specific title which it holds; a plurality of insert dispensing units located along the path downstream from the publication dispensing units, with each holding identical inserts and being capable upon receipt of a command of depositing an insert on a publication located on and being transported by the conveyor; means located along the path downstream from the insert dispensing units for enclosing the publication and any insert deposited on it in an envelope to create a mailing piece; an ink jet printing unit located along the path downstream from the insert dispensing units and being capable, upon receipt of a signal, of directing ink in the form of letters and numbers toward the portion of the mailing piece passing by it so as to impart an address to the mailing piece stacking means located along the path for receiving mailing pieces from the conveyor and arranging them in stacks; and electronic computing means capable of receiving addresses and for directing commands to the publication dispensing units capable of causing the publication dispensing units to dispense in sequence publications of the specified titles required for the addresses at a specific carrier route, for directing additional commands to the insert dispensing units so as to deposit inserts desired to accompany the publications dispensed by the publication dispensing units, for providing signals to the ink jet printing unit suitable for causing that unit to apply the proper address to each mailing piece, and for controlling the stacking means such that each stack contains mailing pieces which bear addresses for only a single carrier route.

2. A machine according to claim 1 and further comprising means for binding a stack of mailing pieces, all bearing addresses for the same carrier route, together into a bundle.

3. A machine according to claim 1 and further including a sensor located along the path beyond the ink jet printing unit for detecting the absence of a publication along the conveyor where a publication should be, the sensor being connected to the computing means for providing a signal indicating the absence of a publication.

4. A machine according to claim 3 wherein the computing means upon receipt of a signal from the sensor indicating the absence of a publication, directs a command to the publication dispensing means and causes it to dispense a publication which fulfills the requirements for the absent publication.

5. A machine according to claim 4 and further comprising rejecting means located along the path between the ink jet printing unit and the stacking means for displacing from the path an out-of-sequence mailing piece, the address of which is directed to a carrier route which does not correspond to the carrier routes in the addresses for either the publication immediately ahead or immediately behind of the out-of-sequence publication.

6. A machine according to claim 1 and further comprising rejecting means located along the path between the ink jet printing unit and the stacking means for displacing from the path an out-of-sequence mailing piece, the address of which is directed to a carrier route which does not correspond to the carrier routes in the addresses for either the mailing piece immediately ahead or immediately behind of the out-of-sequence mailing piece.

7. A machine according to claim 1 wherein the means for enclosing the publication in an envelope wraps a generally transparent polymer film around the publication.

8. A machine according to claim 7 wherein the means for enclosing the publication in an envelope is located between the insert dispensing unit and the ink jet printing unit, and the ink jet printing unit applies the address directly to the polymer film.

9. A machine according to claim 1 wherein the publication dispensing means includes a plurality of units, each capable of holding a publication of a different title, and the computing means selects the unit from which the publication is dispensed so that the publication so dispensed is proper for the addressee.

10. A machine according to claim 9 wherein the insert dispensing means includes a plurality of units, each capable of holding an insert bearing a different message, and the computing means selects the units from which the insert is dispensed so that the insert so dispensed is appropriate for the publication on which it is deposited and for the addressee of that publication.

11. A process for organizing publications by the postal carrier route of the addressees to whom such publications are to be sent, said process comprising: with signals sent by an electronic computer depositing publications of varying titles required for the addresses one after the other on a conveyor with the addressees of such publications being of a specific carrier route; whereby the publications in a sequence will be directed to the same carrier route; tracking the publications with the electronic computer as they move one after the other along the conveyor; selecting with the electronic computer inserts that are appropriate to the publication and the addressee for the publication and depositing such inserts on the publications as they move along the conveyor; encasing each publication and any insert deposited on it in an envelope to create a mailing piece; applying by means of ink jet printing the addressee's address to a portion of the mailing piece, each address and the publication for that address being correlated by the electronic computer; and stacking successive mailing pieces from the conveyor to form bundles, such stacking being controlled by the electronic computer to insure that all mailing pieces of the bundle have addresses bearing the same carrier route.

12. The process according to claim 11 wherein in the step of stacking the mailing pieces the electronic computer further insures that all bundles have a minimum number of mailing pieces.

13. The process according to claim 12 wherein in the step of stacking the mailing pieces the electronic computer further insures that the bundles do not exceed a prescribed weight.

14. The process according to claim 11 and further comprising monitoring the conveyor beyond the location at which the address is applied to insure that an actual publication exists for every publication that is tracked along the conveyor by the computer.

15. The process according to claim 14 and further comprising: reordering a publication which fails to appear where the conveyor is monitored.

16. The process according to claim 15 and further comprising displacing a mailing piece from the conveyor beyond the location at which the address is applied when the carrier route in the address of the mailing piece does not correspond to the carrier routes in the addresses for the mailing pieces immediately ahead of or behind it on the conveyor.

* * * * *